US011484996B1

(12) United States Patent
Wilson

(10) Patent No.: US 11,484,996 B1
(45) Date of Patent: Nov. 1, 2022

(54) DUAL-INTERFACE SEWER CAP REMOVAL DEVICE

(71) Applicant: David A. Wilson, Littleton, CO (US)

(72) Inventor: David A. Wilson, Littleton, CO (US)

( * ) Notice: Subject to any disclaimer, the term of this patent is extended or adjusted under 35 U.S.C. 154(b) by 0 days.

(21) Appl. No.: 17/872,235

(22) Filed: Jul. 25, 2022

Related U.S. Application Data

(60) Provisional application No. 63/301,790, filed on Jan. 21, 2022.

(51) Int. Cl.
*B25B 13/50* (2006.01)
*B25B 23/00* (2006.01)

(52) U.S. Cl.
CPC ..... *B25B 13/50* (2013.01); *B25B 23/0035* (2013.01)

(58) Field of Classification Search
CPC .... B25B 13/50; B25B 13/065; B25B 23/0035
See application file for complete search history.

(56) References Cited

U.S. PATENT DOCUMENTS

| | | | | |
|---|---|---|---|---|
| 2,445,905 | A * | 7/1948 | Busby | B25B 13/02 81/124.3 |
| 4,836,065 | A | 6/1989 | Setliff | |
| 7,044,031 | B1 | 5/2006 | Mullen | |
| 8,701,526 | B2 * | 4/2014 | Scott | B25B 13/065 81/124.6 |
| 10,953,519 | B2 * | 3/2021 | Wilson | B25B 13/065 |
| 11,192,222 | B2 | 12/2021 | Prunean | |
| 2011/0203094 | A1 | 8/2011 | Marciniak et al. | |
| 2020/0298377 | A1 | 9/2020 | Wilson | |

* cited by examiner

*Primary Examiner* — David B. Thomas
(74) *Attorney, Agent, or Firm* — Daniel Boudwin; Boudwin Intellectual Property

(57) ABSTRACT

A dual-interface sewer cap removal device is provided. The device includes a base plate with a first side provided opposite a second side. A first interface is defined on the first side of the base plate. The first interface is designed to engage a slotted sewer cap. A second interface is defined on the second side of the base plate. The second interface is designed to engage a sewer cap. The second interface is structurally distinct from the first interface. An aperture is centrally disposed on the base plate.

8 Claims, 2 Drawing Sheets

DUAL-INTERFACE SEWER CAP REMOVAL DEVICE

CROSS REFERENCE TO RELATED APPLICATIONS

This application claims the benefit of U.S. Provisional Application No. 63/301,790 filed on Jan. 21, 2022. The above identified patent application is herein incorporated by reference in its entirety to provide continuity of disclosure.

BACKGROUND OF THE INVENTION

The present invention relates to a slotted sewer cap removal tool. More specifically, the present invention provides a sewer cap specifically structured to remove two different kinds of sewer caps, including at least one slotted sewer cap.

Sewer caps are utilized to seal off sewer pipes in both residential and commercial buildings. These caps typically are made of metal (such as cast-iron) or plastics (such as PVC). These caps are typically threaded so that they can be threadably engaged with a sewer line. As is common with threaded implements, these caps can become rusted, fused or otherwise adjoined with the sewer lines upon which they are mounted. This can make the removal of the sewer caps extremely difficult and frustrating, even for trained professionals.

Typically, when a sewer cap needs removed, an adjustable pair of water pump pliers are utilized. These pliers, however, tend to slip or slide off of the sewer cap. This slipping and sliding can result in costly damages to the sewer line and the sewer cap, particularly when the sewer caps were overtightened when previously removed or installed. Additionally, this slipping and sliding can be unsafe for the individual attempting to remove the sewer cap, as their fingers can be broken or dislocated with pressure being applied to the water pump pliers.

Adjustable pipe wrenches are also utilized to remove sewer caps from sewer lines. However, these adjustable pipe wrenches are exceptionally large and bulky, as well as heavy. In addition to the damage that can be inflicted upon the sewer cap and sewer line by these adjustable pipe wrenches, these instruments are also unusable when the sewer cap is placed into a hard to reach location, as an increased range of motion is required to applied adequate torque to the sewer cap.

Therefore, there is a defined need amongst the known art for a device that will assist a user in effectively and safely removing a sewer cap from a sewer line. Not only will such a device reduce the damage to the sewer cap, but it will also reduce the risk of personal injury to the user. By applying equally displaced torque to the sewer cap, the breakage risk is reduced. Traditional methods only apply torque to two places upon the sewer cap, increasing the breakage risk along the surface areas between these two points due to uneven pressure.

SUMMARY OF THE INVENTION

In view of the foregoing disadvantages inherent in the known types of sewer cap removal devices and systems now present in the prior art, the present invention provides a dual-interface sewer cap removal device wherein the same can be utilized for providing convenience for the user when removing slotted sewer caps from sewer lines.

The present system comprises a base plate. The base plate defines a first side opposite a second side. A first interface is defined on the first side of the base plate. The first interface is configured to engage a slotted sewer cap. A second interface is defined on the second side of the base plate. The second interface is configured to engage a sewer cap. The second interface is structurally distinct from the first interface, such that the second interface will engage a different sewer cap than the first interface.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
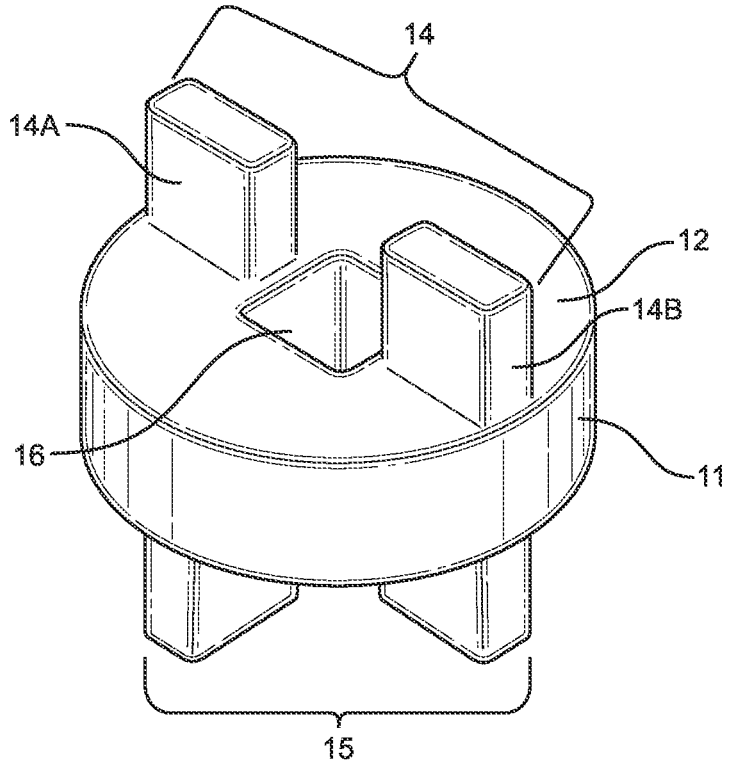
FIG. 1A shows a first perspective view of an embodiment of the dual-interface sewer cap removal device.

Reference is made herein to the attached drawings. Like reference numerals are used throughout the drawings to depict like or similar elements of the dual-interface sewer cap removal device. The figures are intended for representative purposes only and should not be considered to be limiting in any respect.

Referring now to FIG. 1A, there is shown a first perspective view of an embodiment of the dual-interface sewer cap removal device. The dual-interface sewer cap removal device 10 comprises a base plate 11. The base plate 11 provides a structural foundation for the dual-interface removal device 10. As such, the base plate 11 is made of a durable, rigid material, so that it will not be deformed or damaged when pressure or torque is applied to the base plate 11. In the illustrated embodiment, the base plate 11 is circular.

The base plate 11 comprises a first side 12 disposed opposite a second side 13. The base plate 11 comprises an aperture 16. The aperture 16 is configured to be engaged by a socket, or other implement, capable of enacting rotational movement of the base plate 11. Specifically, in the illustrated embodiment, the aperture 16 consists of four sides of equal length. The aperture, in the demonstrated embodiment comprises beveled edges, such as to enable smooth insertion of a socket into the aperture 16.

The first side 12 comprises a first interface 14. The first interface 14 is configured to engage a slotted sewer cap. In the illustrated embodiment, the first interface 14 comprises a pair of protrusions 14*a*, 14*b*. The pair of protrusions 14*a*,14*b* consists of a first protrusion 14*a* and a second protrusion 14*b*. The first protrusion 14*a* and the second protrusion 14*b* are linearly parallel and disposed on opposing sides of the aperture 16. The first protrusion 14*a* and the second protrusion 14*b* are structurally identical. In the illustrated embodiment, the pair of protrusions 14*a*, 14*b* are of a rectangular cross section and comprise beveled edges. The beveled edges reduce the risk of damage to the sewer cap or to other objects in the vicinity of the dual-interface sewer cap removal device 10.

Figure 1B:
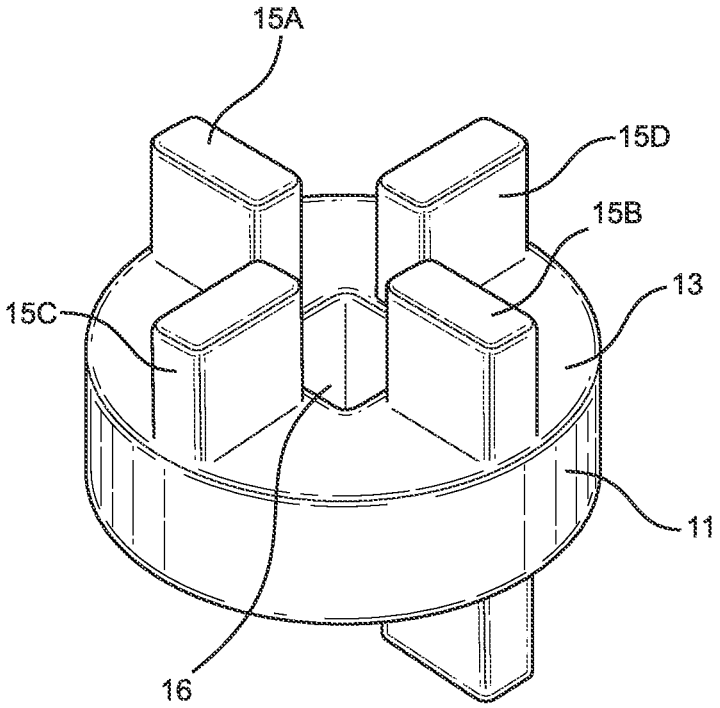
FIG. 1B shows a second perspective view of an embodiment of the dual-interface sewer cap removal device.

Referring now to FIG. 1B, there is shown a second perspective view of an embodiment of the dual-interface sewer cap removal device. A second interface 15 is disposed on the second side 13 of the base plate 11. The second interface 15 is configured to engage a sewer cap. The second interface 15 is structurally distinct from the first interface 14. As such, the dual-interface sewer cap removal device 10 may be utilized to remove two different types of sewer caps.

In the illustrated embodiment, the second interface 15 comprises four protrusions 15*a*, 15*b*, 15*c*, 15*d*, wherein a first pair of protrusions 15*a*,15*b* are linearly parallel on opposing sides of the aperture 16 and the second pair of protrusions 15*c*,15*d* are linearly parallel on opposing sides of the aperture 16, wherein the second pair of protrusions 15*c*,15*d* are linearly perpendicular to the first pair of protrusions 15*a*,15*b*. As such, the second interface 15 of the illustrated embodiment is configured to engage a cross-shaped sewer cap.

Each protrusion of the first pair of protrusions 15*a*,15*b* and the second pair of protrusions 15*c*,15*d* are structurally identical. In the illustrated embodiment, the first pair of protrusions 15*a*, 15*b* and the second pair of protrusions 15*c*,15*d* are of a rectangular cross section and comprise beveled edges. The beveled edges reduce the risk of damage to the sewer cap.

Figure 2A:
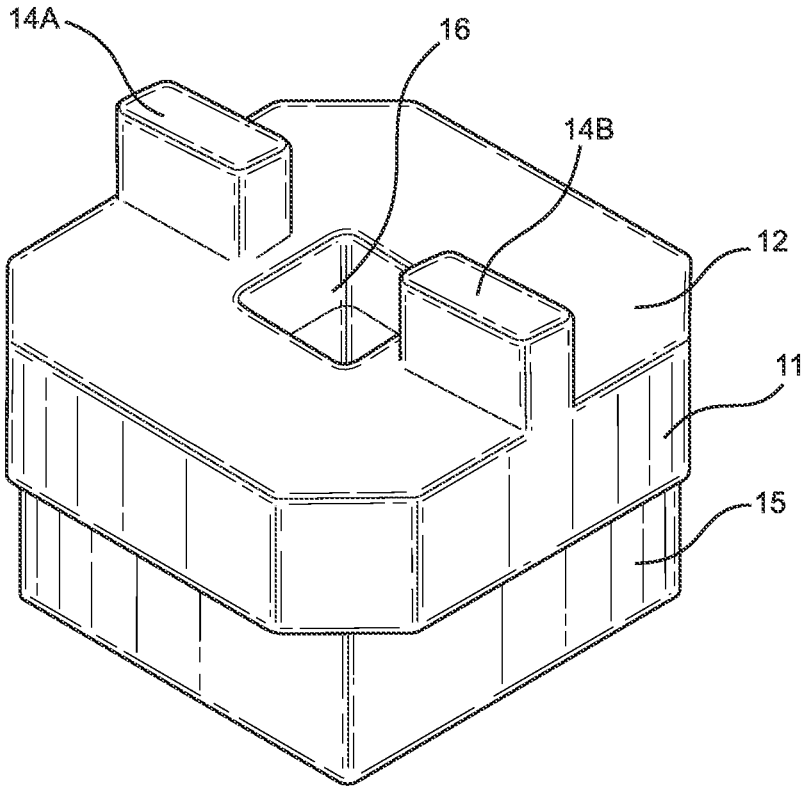
FIG. 2A shows a first perspective view of an embodiment of the dual-interface sewer cap removal device.

Referring now to FIG. 2A, there is shown a first perspective view of an embodiment of the dual-interface sewer cap removal device. In the illustrated embodiment, the base plate 11 of the dual-interface sewer cap removal device 10 is octagonal. An aperture 16 is centrally disposed within the base plate 11. In the illustrated embodiment, the aperture 16 is beveled to provide smooth engagement of a socket with the aperture 16. In the illustrated embodiment, the aperture 16 extends entirely through the base plate 11 (shown in FIG. 2B). As such, the aperture 16 may be engaged by a socket from each side of the base plate 11.

In the illustrated embodiment, first side 12 comprises a first interface 14. The first interface 14 is configured to engage a slotted sewer cap. In the illustrated embodiment, the first interface 14 comprises a pair of protrusions 14*a*, 14*b*. The pair of protrusions 14*a*,14*b* consists of a first protrusion 14*a* and a second protrusion 14*b*. The first protrusion 14*a* and the second protrusion 14*b* are linearly parallel and disposed on opposing sides of the aperture 16. The first protrusion 14*a* and the second protrusion 14*b* are structurally identical. In the illustrated embodiment, the pair of protrusions 14*a*, 14*b* are of a rectangular cross section and comprise beveled edges. The beveled edges reduce the risk of damage to the sewer cap or to other objects in the vicinity of the dual-interface sewer cap removal device 10. Alternatively, the first side 12 of the base plate 11 may comprise four protrusions as shown and described in FIG. 1B to provide an interface for engaging a cross-shaped sewer cap.

Figure 2B:
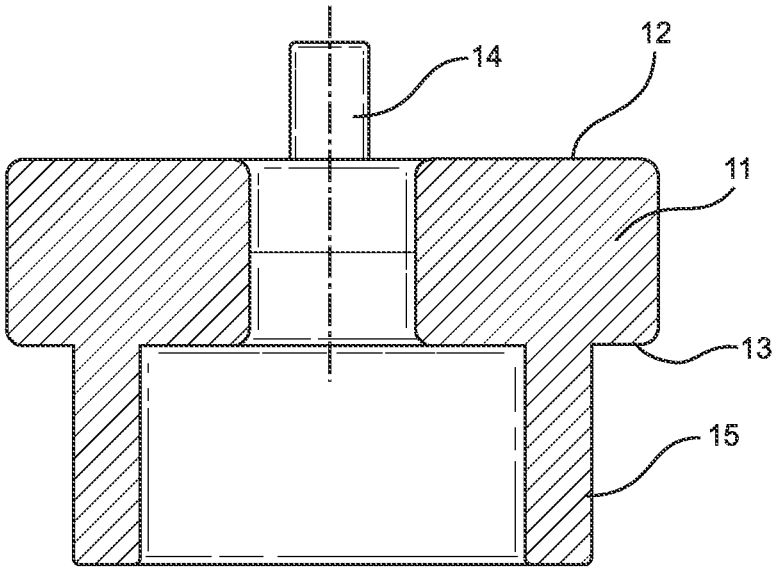
FIG. 2B shows a second perspective view of an embodiment of the dual-interface sewer cap removal device.

Referring now to FIG. 2B, there is shown a second perspective view of an embodiment of the dual-interface sewer cap removal device. The second interface 15 is disposed on the second side 13 of the base plate 11. In the illustrated embodiment, the second interface 15 comprises a lower wall extending from the second side of the base plate. The lower wall forms a square shape, wherein the square shape is configured to engage a traditional sewer cap. The square shape comprises rounded corners, such as to reduce the strain on the sewer cap.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dual-interface sewer cap removal device, comprising:
a base plate having a first side and a second side;
a first interface defined on the first side of the base plate;
the first interface configured to engage a slotted sewer cap;
a second interface defined on the second side of the base plate;
wherein the second interface is configured to engage a sewer cap;
wherein the second interface is structurally distinct from the first interface;
an aperture centrally disposed on the base plate.

2. The dual-interface sewer cap removal device of claim 1, wherein the aperture comprises a socket interface dimensioned to receive a socket wrench.

3. The dual-interface sewer cap removal device of claim 1, wherein the aperture comprises an interface dimensioned to receive a breaker bar.

4. The dual-interface sewer cap removal device of claim 1, wherein the first interface comprises a pair of protrusions linearly parallel on opposing sides of the aperture.

5. The dual-interface sewer cap removal device of claim 1, wherein the second interface comprises four protrusions, wherein a first pair of protrusions are linearly parallel on opposing sides of the aperture and the second pair of protrusions are linearly parallel on opposing sides of the aperture, wherein the second pair of protrusions are linearly perpendicular to the first pair of protrusions.

6. The dual-interface sewer cap removal device of claim 1, wherein the second interface comprises a lower wall extending from the second side of the base plate.

7. The dual-interface sewer cap removal device of claim 6, wherein the lower wall is of a square shape having rounded corners.

8. The dual-interface sewer cap removal device of claim 1, wherein the aperture is disposed entirely through the base plate.

* * * * *